United States Patent [19]

Tulen et al.

[11] 4,276,686

[45] Jul. 7, 1981

[54] REPLACEMENT SPOONS & FIXTURES FOR ROTARY HOE

[76] Inventors: Jack A. Tulen, R.R. #1, Coatsworth, Ontario, Canada, N0P 1H0; James L. Tulen, R.R. #1, Wheatley, Ontario, Canada, N0P 2P0

[21] Appl. No.: 83,158

[22] Filed: Oct. 9, 1979

[51] Int. Cl.[3] ..... B25P 27/00

[52] U.S. Cl. ..... 29/270; 29/281.1

[58] Field of Search ..... 29/270–271, 29/267, 281.1, 281.5, 281.6; 228/49 R

[56] References Cited

U.S. PATENT DOCUMENTS

| | | | |
|---|---|---|---|
| 1,324,197 | 12/1919 | Kowalski | 29/270 X |
| 1,515,349 | 11/1924 | Lossius | 29/270 |
| 1,596,678 | 8/1926 | Miller | 29/270 |

*Primary Examiner*—Robert C. Watson

*Attorney, Agent, or Firm*—Chas. Krassov

[57] ABSTRACT

This invention consists of a device by means of which worn out spoons on the teeth of the wheels of rotary hoes can be easily replaced. It consists of individual spoons which replace the worn out spoons, and portable fixtures which guide and hold the new spoons in the proper position for welding them to the existing teeth.

3 Claims, 7 Drawing Figures

REPLACEMENT SPOONS & FIXTURES FOR ROTARY HOE

A modern type of hoe which is used to break up the soil between rows of growing plants, is the rotary hoe which consists primarily of a number of spaced, rotating wheels which are mounted on a horizontal shaft. These wheels consist of a central hub from which extend, radially, a number of equally spaced, elongated teeth which terminate at their free ends into attached spoon-shaped diggers, which, for the purpose of this description will be referred as spoons.

The abrasive action of the soil upon the spoons, wears them down, after a comparatively short period of use, so that they have to be replaced. The present day practice consists of replacing the entire wheel, making it a very costly operation. One solution to the problem consists of retaining the original wheel and welding on or in any other manner attaching new spoons to the existing wheel teeth. Since this requires the services of skilled machinists working with machine shop equipment, the cost of replacement of the spoons made the operation almost as expensive as the replacement of the entire wheel.

It therefore became obvious that the solution to the problem consists in providing a means for replacing the spoons by the owner or his help, who usually are not trained machinists and to whom there is no available machine shop tools, except a simple welding unit.

This is accomplished with the aid of this invention which consists of a lightweight portable fixture which holds the spoon up against the tooth in the proper position for welding it to the tooth.

Figure 1:
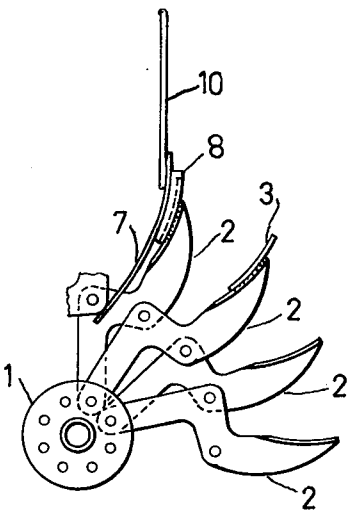
Figure 2:
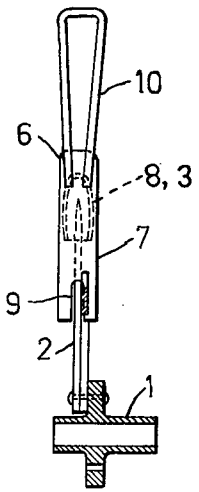
Figure 3:
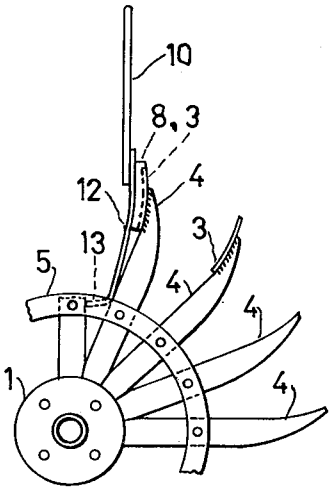
Figure 4:
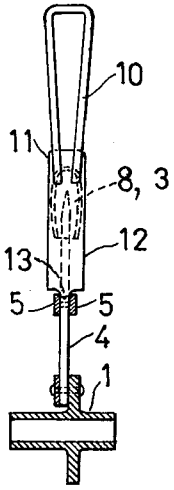
Figure 5:
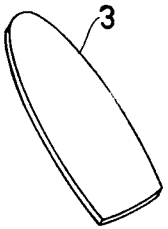
Figure 6:
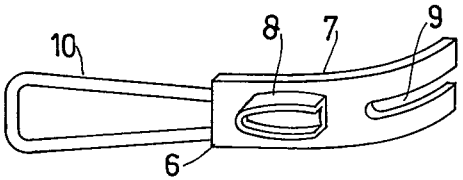
Figure 7:
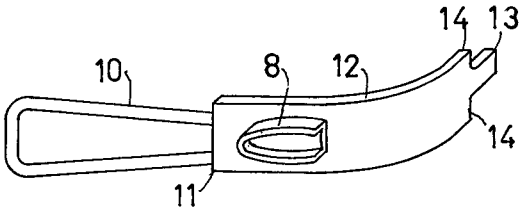

In describing the invention, reference will be made to the attached drawing in which, FIG. 1, shows a front view of part of a hoe wheel with the invention attached thereto, FIG. 2, shows a side view of FIG. 1, FIG. 3, shows a front view of another form of a hoe wheel with a variation of the invention attached thereto, FIG. 4, shows a side view of FIG. 3, FIG. 5, shows a view of the spoons, FIG. 6, shows a detailed view of the invention, and FIG. 7, shows a detailed view of the variation in the invention.

In the drawings, FIG. 1, shows the construction of one of the commonly used hoe wheels, having a hub 1, to the perimeter of which are radially attached a number of equally spaced, flat place teeth 2 which are offset at about their centers to allow the teeth 2 to be attached to each other. Attached to the free end of each tooth is a spoon 3, the rounded edge of which extend beyond the tip of the tooth 2. A detail of the spoon 3, is shown in FIG. 5. It has a straight base at the bottom, a rounded tip at its top, and is slightly concave.

A common variation in the structure of the hoe wheel is shown in FIG. 3. In this case, the teeth 4, are attached to each other by means of a ring 5 abuting the teeth 4, on each side, said teeth being rivetted to said rings.

The invention shown in FIG. 6, is a fixture 6 by means of which the replacement spoon 3 can be held in the proper location on the tooth 4, while it is being welded thereto. It consists of a curved plate 7, made of iron or steel, wide enough for attachment to it, at the upper end of its convex side, an open faced container 8, into which fits tightly one of the spoons 3. The bottom end of the plate 7 is cut into a centrally located notch 9, which runs part way up the plate. A U-shaped handle 10 is attached to the upper edge of the concave side of the plate 7.

In FIGS. 1 and 2, is shown the manner in which the fixture 6 is used in the welding of the replacement spoon 3, to the tooth 2. The procedure consists of fitting the spoon 3 into the container 8, placing the plate 7 so that the notch 9 straddles the offset part of the tooth 2; the fixture 6, is then pressed and held against the tooth 2 by the handle 10, so that the convex face of the spoon in the container makes contact with the tooth, and is then welded to it. The container 8 is located on the plate 7, to provide the exact location of the spoon on the tooth.

In a similar manner, the fixture 11, is used to weld the spoon 3 to the teeth of the wheel shown in FIGS. 3 and 4. The fixture 11, is provided with a plate 12 which is similar to the plate 7, except that its bottom end terminates into a short, narrow, centrally located extension 13, which when the fixture 11 is to be used on the wheel shown in FIG. 3, is inserted between the rings 5,5, so that the shoulders 14,14, rest upon the upper perimeter of the said rings. In each of the fixtures 6 and 11, the container 8, and the handle 10 are identical. The procedure for welding the spoon to the tooth is the same as above, in connection with the wheel shown in FIG. 1.

We claim:

1. For a rotary hoe wheel having a hub, a plurality of teeth having end portions attached to said hub and extending outwardly therefrom, means spaced outwardly from said hub for attaching said teeth together to hold them in spaced relationship relative to said hub, and spoons affixed to free end portions of said teeth; a device for replacing worn out spoons with new ones, by means of which new spoons are held in the proper position and location against the teeth as the spoons are being affixed to the teeth, said device comprising a narrow plate, an open faced shallow container attached to a side surface of said plate for holding therein a single new spoon, locating means at one end portion of said narrow plate effective to cooperate with said attaching means for positioning said container relative to a tooth to which a new spoon is to be affixed, and handle means connected to the other end portion of said narrow plate for extending outwardly beyond said container, whereby said device can be held by said handle means when a spoon located in said container is to be affixed to one of said teeth.

2. A device according to claim 1 wherein said attaching means for said device is an offset in each of said teeth and fastener means affixing the offsets to adjacent teeth, said locating means of said device comprising a centrally located notch in the one end portion of said narrow plate, said notch being positioned to straddle the offset of one of said teeth while the new spoon held by said container is affixed to the same tooth.

3. A device according to claim 1 wherein said attaching means for said teeth comprises two rings, one located on each side of said teeth and affixed to said teeth, said locating means of said narrow plate comprising a centrally located, narrow extension at the one end portion of the plate to be inserted between said rings when a new spoon carried in said container is to be affixed to one of said teeth.

* * * * *